US006520860B1

(12) United States Patent
Jensen

(10) Patent No.: US 6,520,860 B1
(45) Date of Patent: Feb. 18, 2003

(54) TOOL RING AND A NAIL MACHINE COMPRISING SUCH TOOL RING

(75) Inventor: Jørn Boie Jensen, Ebeltoft (DK)

(73) Assignee: Enkotec A/S, Skanderborg (DK)

( * ) Notice: Subject to any disclaimer, the term of this patent is extended or adjusted under 35 U.S.C. 154(b) by 0 days.

(21) Appl. No.: 09/647,387

(22) PCT Filed: Mar. 31, 1999

(86) PCT No.: PCT/DK99/00197

§ 371 (c)(1),
(2), (4) Date: Nov. 3, 2000

(87) PCT Pub. No.: WO99/51377

PCT Pub. Date: Oct. 14, 1999

(30) Foreign Application Priority Data

Apr. 3, 1998 (DK) ..... 0481/98

(51) Int. Cl.[7] ..... B21G 3/00
(52) U.S. Cl. ..... 470/129; 470/121
(58) Field of Search ..... 470/121, 129, 470/137, 140, 179

(56) References Cited

U.S. PATENT DOCUMENTS

| | | | | |
|---|---|---|---|---|
| 2,917,756 A | | 12/1959 | Sterns et al. | 10/52 |
| 3,222,702 A | * | 12/1965 | Lofgren et al. | 470/179 |
| 5,050,260 A | * | 9/1991 | Nielsen | 470/129 |
| 5,081,732 A | * | 1/1992 | Steinhilber | 470/129 |
| 5,651,739 A | * | 7/1997 | Carson | 470/129 |
| 5,833,543 A | * | 11/1998 | Yang | 470/179 |

FOREIGN PATENT DOCUMENTS

| | | |
|---|---|---|
| DK | 143935 B | 11/1981 |
| DK | 163111 B | 1/1992 |
| SU | 379119 A | 6/1986 |
| SU | 1645056 | 4/1991 |

OTHER PUBLICATIONS

English Abstract of SU 379119A dated Jun. 30, 1986.
English Abstract of SU 1645056 dated Apr. 30, 1991.

* cited by examiner

*Primary Examiner*—Ed Tolan
(74) *Attorney, Agent, or Firm*—Ladas & Parry

(57) ABSTRACT

A nail machine and a tool ring for securing elongate bodies in the manufacture of heads on the elongate bodies. The tool ring has an axis of rotation, an outer circumference and a surface that extends substantially perpendicular to the axis fo rotation, and wherein the tool ring comprises a number of engagement devices spaced substantially equally at the circumference of the tool ring for receiving and releasably securing the elongate bodies. Each of the engagement devices has two mutually opposed holding jaws, at least one of which is movable and arranged on a movement mechanism so that it can be displaced towards and away from the opposed holding jaw. The engagement devices also have two opposed holding trays which are movable towards one another. The movement mechanism is arranged so that it displaces the movable holding jaw in a radial or axial direction relative to the axis of rotation of the tool ring to engage and position the elongate body and then clamp the elongate body by the holding trays with greater force to hold the elongate body securely while the head is formed thereon.

14 Claims, 7 Drawing Sheets

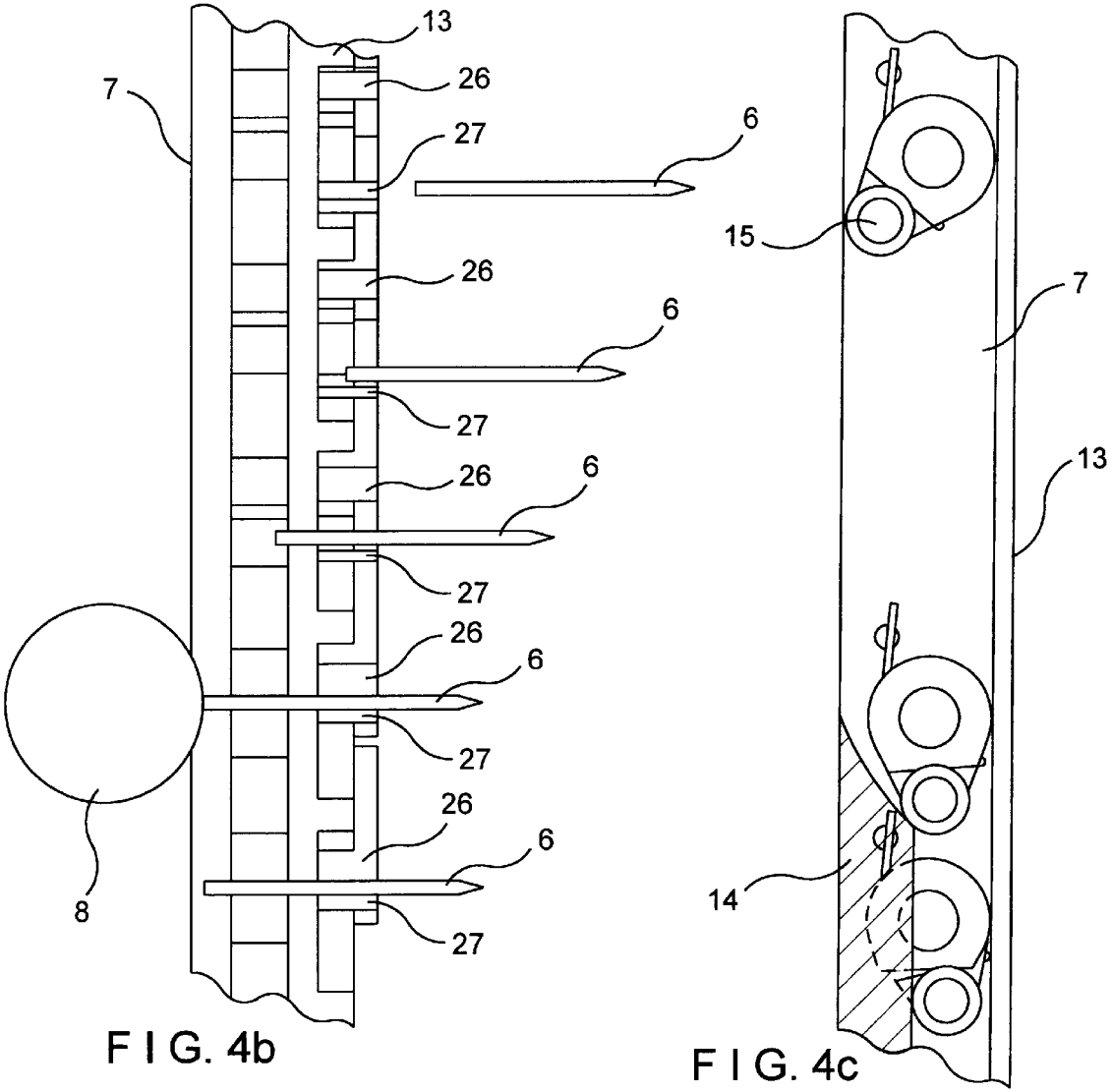
FIG. 4c
FIG. 4b
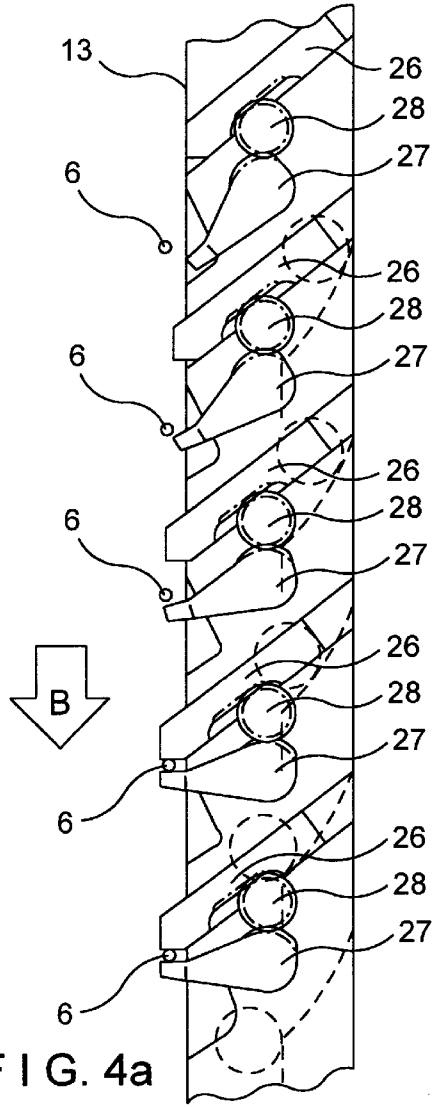
FIG. 4a

TOOL RING AND A NAIL MACHINE COMPRISING SUCH TOOL RING

FIELD OF THE INVENTION

The present invention relates to a tool ring for securing preferably elongate bodies in a machine, eg for the manufacture of heads on said elongate bodies, said tool ring having an axis of rotation, an outer circumference and a surface extending substantially perpendicular to the axis of rotation; and wherein the tool ring further comprises a number of engagement means arranged for receiving and releasably securing bodies and spaced substantially equally apart at the circumference of the tool ring, said engagement means each comprising two mutually opposed holding jaws, and wherein at least one of the two holding jaws is/are arranged on a movement mechanism which is arranged to enable the holding jaw to be displaced towards and away from, respectively, the opposed holding jaw.

BACKGROUND AND PRIOR ART

Such tool ring is known ia from Danish patent Nos 143 935 and 163 111. The tool ring is used in these machines for the manufacture of nails, wherein the tool ring is rotatably suspended about the axis of rotation of the tool ring opposite a wire cutter that serves to cut off elongate wire bodies from a storage of metal wire and shift said elongate bodies onwards for receiving and securing on the tool ring. The tool ring is arranged opposite a second tool ring, the circumference of which corresponds to this tool ring, but it is not provided with engagement means. This second tool ring is also rotatably suspended about an axis of rotation which is substantially coaxial with the axis of rotation of the first tool ring, but having an angulation of a few degrees relative to the axis of rotation of the first tool ring, whereby an elongate body arranged between the tool rings is secured there between in that area where the distance between the tool rings is relatively small, and wherein the elongate body is loosened between the tool rings at the substantially opposite side of the tool rings.

In this context, the term 'nail' is used to designate any object having a shaft which is, at its one end, provided with a head.

In the area where the elongate body is secured between the two tool rings, the wire body is so well secured that it is possible to forge or roll a head onto the one end of the wire body, and for this purpose the tool rings are, at each engagement means, provided with a plurality of opposed pairs of holding trays made of an extremely wear resistant material and each having a groove for receiving the elongate body. Here the engagement means in the tool ring serves to engage with the elongate body and to secure and position it in such a manner that with a high degree of certainty the body will be correctly positioned in the groove in the holding trays when the holding trays closes in on the elongate body.

Thus, the known nail machines function by the tool rings being caused to rotate synchronously about their axes of rotation, whereby the individual pairs of holding trays are successively conveyed past the wire cutter that inserts an elongate body between the tool rings, each of said engagement means engaging with and positioning an elongate body between the two tool rings which subsequently, by their rotation, remove the elongate object and lock it between the tool rings, following which a head is rolled onto the one end of the elongate body, and wherein the tool rings subsequently release the elongate body in the form of a nail or the like.

It is a problem with these prior art nail machines to control and synchronise the wire cutter to ensure that the individual elongate bodies are reliably introduced between the holding jaws on each of the engagement means, said holding jaws being arranged in or radially opposite the space between the tool rings. In practice, this means that the speed of rotation of the tool rings is restricted by the need for introducing an elongate body during that period of time when the engagement means are positioned directly opposite the wire cutter, and that the productivity can be increased for a given nail machine only if the number of holding trays with accompanying engagement means is increased. In practice this means that the known tool rings typically contain about 20 to 40 sets of holding trays and accompanying engagement means.

SUMMARY OF THE INVENTION

In the light of this, it is the object of the present invention to provide a tool ring that allows a higher degree of freedom when it comes to obtaining a desired productivity for a given nail machine without necessarily entailing that a given number of holding trays with accompanying engagement means are required.

This is obtained by use of a tool ring as described in the introductory part and characterised in that the movement mechanism for displacing at least the one holding jaw is so configured that it displaces the holding jaw completely or partially in a radial or axial direction relative to the axis of rotation of the tool ring. As opposed to the known tool rings, and provided the tool ring is rotated such that the displaceable holding jaw of each pair of holding jaws is located opposite the opposed holding jaw in the direction of rotation of the tool ring, this enables the elongate body to be advanced to the tool ring to occupy a position in which the elongate body can be seized by the holding jaws in the engagement device before said engagement means becomes positioned opposite the wire cutter. This means that, at a given speed of rotation for the tool ring, more time is available for introducing the elongate body whereby the above-described limitation imposed on the productivity obtainable with a given tool ring having a given number of holding trays and accompanying engagement means is eliminated or at least considerably reduced.

According to a particularly preferred embodiment of the invention it is obtained that undesired variations in the positioning of the individual elongate bodies due to play, if any, in the movement mechanisms of the engagement means, are eliminated or at least considerably reduced by one of the holding jaws in the engagement means being immovably secured on the tool ring, and by the tool ring being configured for rotation in such direction that the immovable holding jaw in each engagement means is situated opposite the immovably secured holding jaw.

Advantageously the engagement means is arranged for receiving and securing the elongate bodies in such a manner that the elongate bodies extend completely or partially opposite that surface of the tool ring which is arranged substantially perpendicular to the axis of rotation, and substantially radially inwards towards the axis of rotation of the tool ring and wherein the movement mechanism is so configured that it displaces the movable holding jaw completely or partially in a direction which is axial in relation to the axis of rotation of the tool ring. Hereby it is accomplished that the individual elongate bodies can be introduced radially between the tool ring according to the present invention and a second tool ring arranged oppositely as described above with reference to the prior art nail machines.

According to a particularly simple and reliable embodiment, each of the movement mechanisms in the tool ring is so configured as to comprise a shaft which is rotatably arranged in the tool ring; and the movable holding jaw is arranged on a lever which is secured to the shaft of the movement mechanism and extends radially therefrom; and a cam follower is also mounted on the rotatable shaft. Hereby a movement mechanism is established that comprises only a rotatable bedding of the movement mechanism whereby a mechanism is provided which is relatively maintenance-free.

The cam follower is advantageously spring actuated such as to move the movable jaw against the opposed jaw. Thereby no adjustments are necessary in order to produce nails from wires having different diameters.

According to a preferred embodiment, the tool ring is so configured that the rotatable shaft of the movement mechanism is arranged such that its axis of rotation points substantially radially inwards towards the axis of rotation of the tool ring. Hereby a movement pattern is obtained for the movable holding jaw that ensures that, in its position near the opposed holding jaw, the movable holding jaw moves substantially in a direction perpendicular to the opposed holding jaw.

According to a particularly preferred embodiment, the tool ring has such configuration that the immovably secured holding jaw has a substantially planar holding surface that faces in the direction of rotation of the tool ring; and that the movable holding jaw has a substantially planar holding surface that faces essentially towards the immovably secured holding surface. Hereby adequate attachment of the elongate bodies is obtained which ensures that the bodies are correctly positioned.

Furthermore, the present invention relates to a nail machine comprising a tool ring according to the preceding, wherein said nail machine is characterised in comprising a drive device for pulling off a metal wire from a storage, a device for stretching and straightening the wire, a cutter for cutting off desired lengths of elongate bodies of said wire, means for introducing the elongate bodies into the tool ring, a roller for rolling heads onto the elongate body, and means for removing and collecting the elongate bodies provided with heads and to convey said elongate bodies away from the nail machine.

BRIEF DESCRIPTION OF THE DRAWINGS

The invention will now be described in further detail with reference to the drawings, wherein:

FIG. 4*a* is a sketch illustrating a sectional view of a first alternative embodiment of a tool ring according to the invention, seen radially from the outside of the tool ring;

FIG. 4*b* is a sketch illustrating a front view of the embodiment of a tool ring according to the invention shown in FIG. 4*a*, but where the ring has been straightened for space considerations.

FIG. 4*c* is a sketch illustrating the embodiment of a tool ring shown in FIGS. 4*a* and 4*b*, seen from the centre of the tool ring and radially outwards to the side.

DETAILED DESCRIPTION

Figure 1:
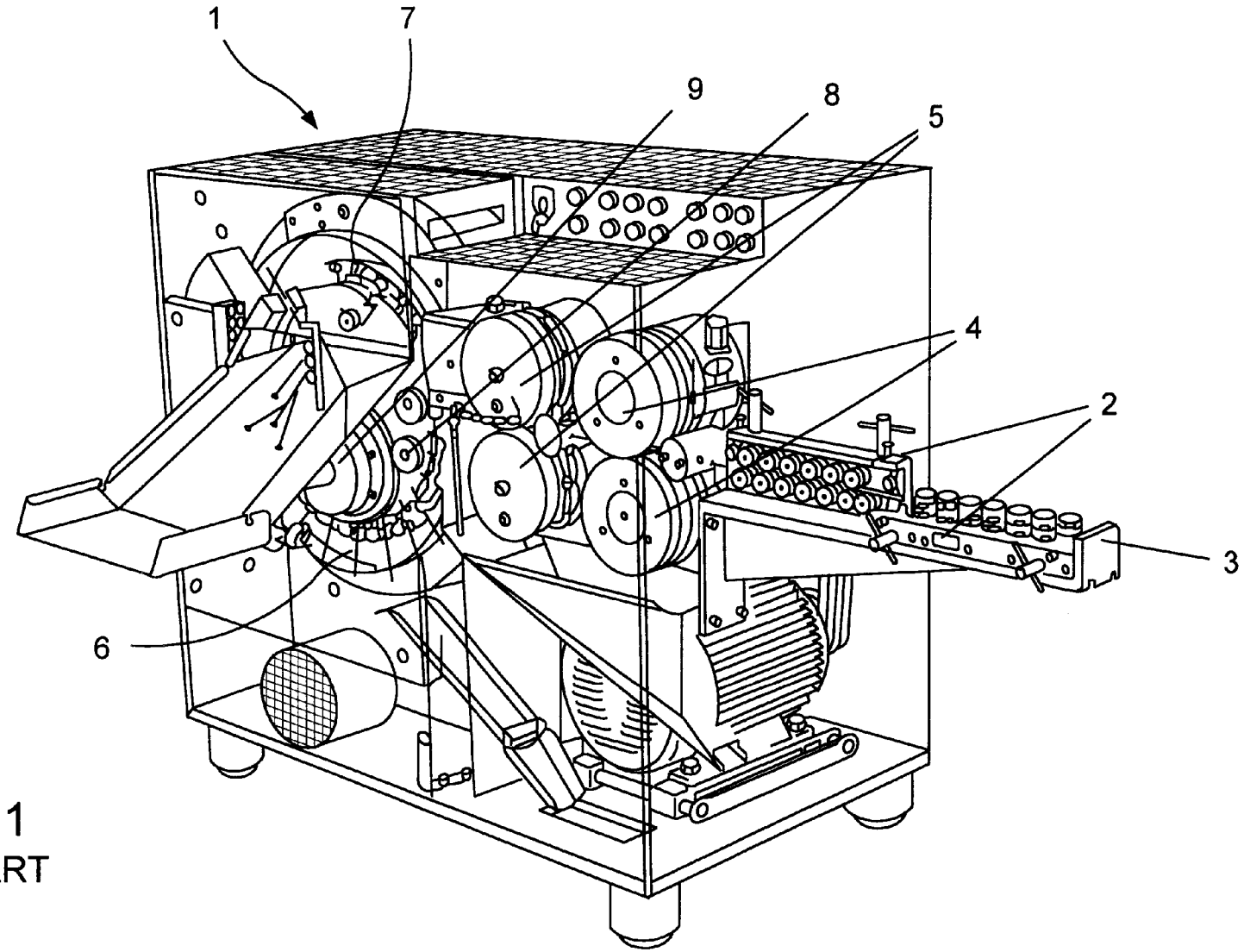
FIG. 1 PRIOR ART
FIG. 1 is a perspective explanatory sketch of a prior art nail machine which is known in principle and provided with a tool ring according to the present invention.

Thus, FIG. 1 illustrates a nail machine 1 comprising a stretching station 2, through which an arrangement of drive rollers 4 serves to pull a metal wire 3 from a not shown coil of wire, and wherein the metal wire is hereby straightened and stretched to a substantially completely straight piece of wire. After the drive rollers 4, the metal wire is displaced into a wire cutter consisting of two rotating wire cutters 5, and from the rotating cutters 5 the pieces of wire 6 cut off the wire 3 are displaced into a tool ring 7 that rotates clockwise in the embodiment shown herein. The individual pieces of wire are secured and positioned by a roller 8 intended therefor, whereby the pieces of wire are caused to extend equal distances towards the centre of the ring. At the lowermost area of the tool ring, a roller 9 is arranged that is configured to co-operate with the tool ring 7 for rolling heads onto the individual pieces of wire 6. The wire pieces 6 provided with heads are subsequently advanced in the tool ring and upwards to the uppermost part of the tool ring 7, where the piece of wire provided with head is released from the tool ring and drops down onto a chute 10 that conveys the piece of wire away from the nail machine.

The above mentioned tool machine and its functioning are generally known; and the present invention specifically relates to a tool ring that distinguishes itself by increasing the productivity relative to the number of tools arranged in the tool ring compared to the prior art devices.

Thus, the following figures illustrate specific embodiments of the invention in the form of tool rings that may, in principle, successfully be used in connection with the machine shown in FIG. 1.

Figure 2C:
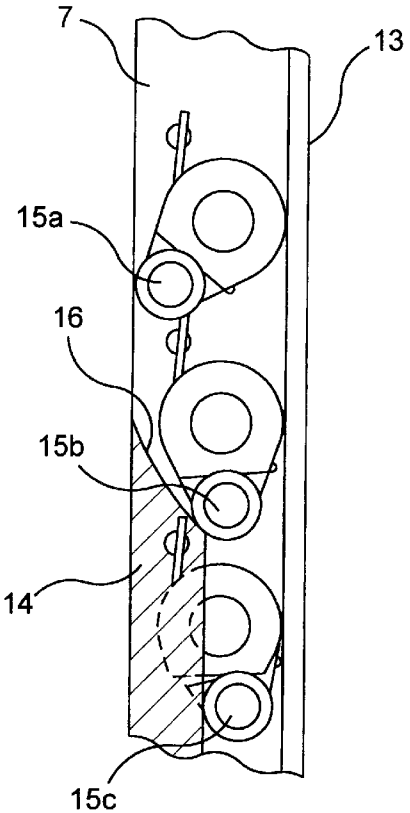
FIG. 2*c* is a sketch of the embodiment of the tool ring shown in FIGS. 2*a* and 2*b*, seen from the centre of the tool ring and radially outwards to the side.
Figure 2B:
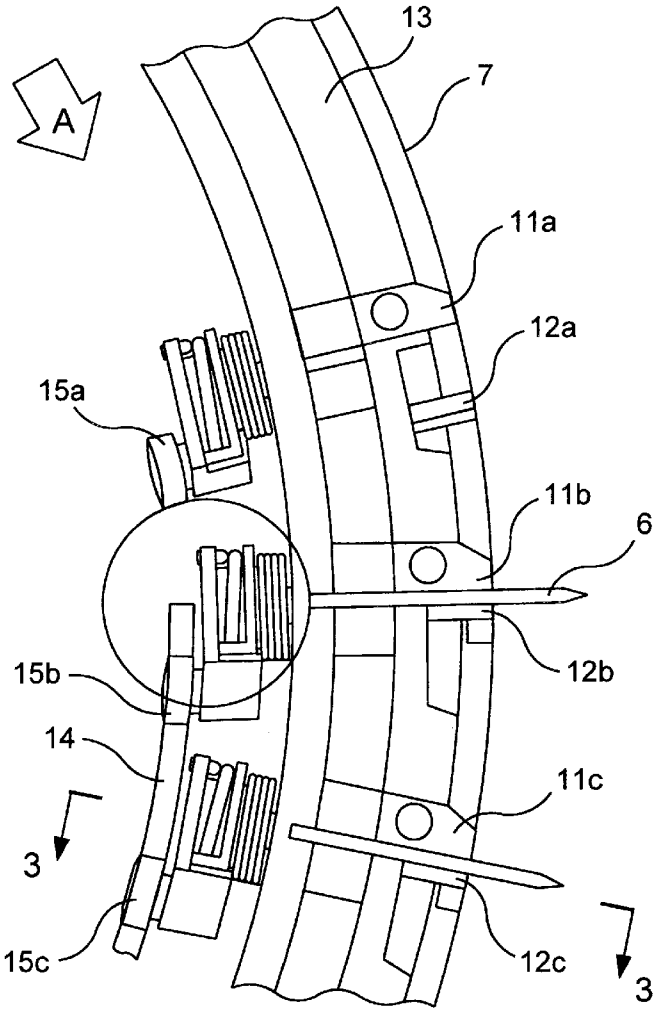
FIG. 2*b* is a front view sketch of the embodiment shown in FIG. 2*a* of a tool ring according to the invention.
Figure 2A:
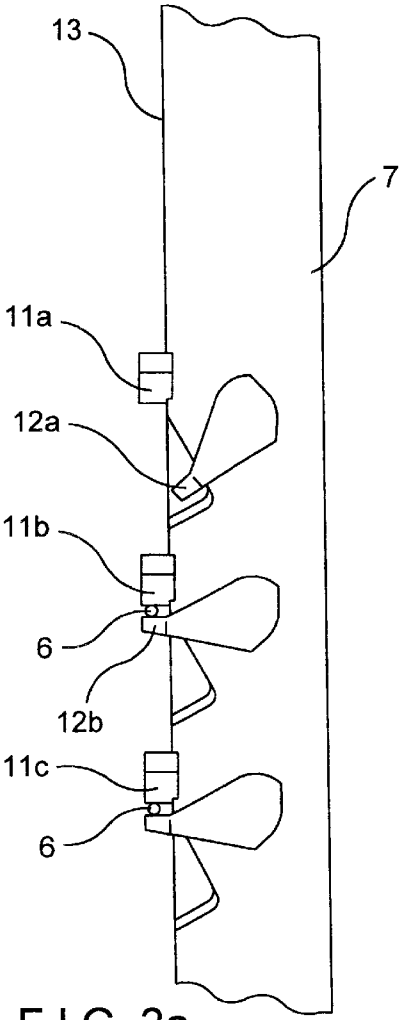
FIG. 2*a* is a sketch of a section of one embodiment of a tool ring according to the invention, seen radially from the outside of the tool ring.

Thus, FIGS. 2*a*, 2*b* and 2*c* outline a first embodiment of a tool ring 7 according to the invention, wherein FIG. 2*a* is a sectional view of an embodiment of a tool ring according to the invention, seen radially from the outside of the tool ring. As will appear three identical sets of holding jaws are shown that each comprises a fixed holding jaw 11*a*, 11*b*, 11*c*, respectively, mounted on the tool ring 7 and a second movable holding jaw 12*a*, 12*b*, 12*c* that may rotate about an axis perpendicular to the plane of the paper. The holding jaw 12*a* is shown in the position it occupies before the holding jaws 11*a* and 12*a* are opposite the spot where a piece of wire 6 is inserted towards the tool ring 7. As will appear, in accordance with the present invention the movable holding jaw 12*a* is, in this position, displaced axially relative to the axis of rotation of the tool ring such that it is drawn down below the plane defined by the surface 13 of the tool ring 7, whereby a cut-off piece of wire 6 can be inserted to the tool ring across the surface 13 on the tool ring 7 soon enough for the movable jaw to be able to pass the piece of wire 6 without touching it.

The holding jaws 11*b* and 12*b* are subsequently shown in a second position, following insertion of a piece of wire 6 to the tool ring 7, and wherein the movable holding jaw 12*b* has been pivoted such as to press the piece of wire 6 towards the fixed holding jaw 11*b*. Finally, the same position is shown illustrated at the holding jaws 11*c* and 12*c*.

Now FIG. 2*b* illustrates the same positions as shown in FIG. 2*a*, only as front views on the tool ring 7, perpendicular to the surface 13. The arrow A in FIG. 2*b* illustrates the direction of rotation of the tool ring. It will further appear that the holding jaws 12*a*, 12*b* and 12*c* are moved by means of a cam device 14 mounted on the frame of the nail machine and respective cam followers intended for each of the holding jaws 12*a*, 12*b* and 12*c* in the form of a roller 15*a*, 15*b*, 15*c*. The principle behind the movement mechanism shown will now be described in further detail below with reference to FIG. 3.

FIG. 2*c* also illustrates the same positions of the holding jaws as seen in FIGS. 2*a* and 2*b*, but seen from the centre of the tool ring 7 and radially outwards. Here the cam device is seen in a lateral view; and it will appear that the cam device has a ramp 16 that brings about the movement that the movable holding jaws perform from the position illustrated at the holding jaw 12*a* in FIG. 2*a* to the position illustrated at the holding jaw 12*b*.

Figure 3:
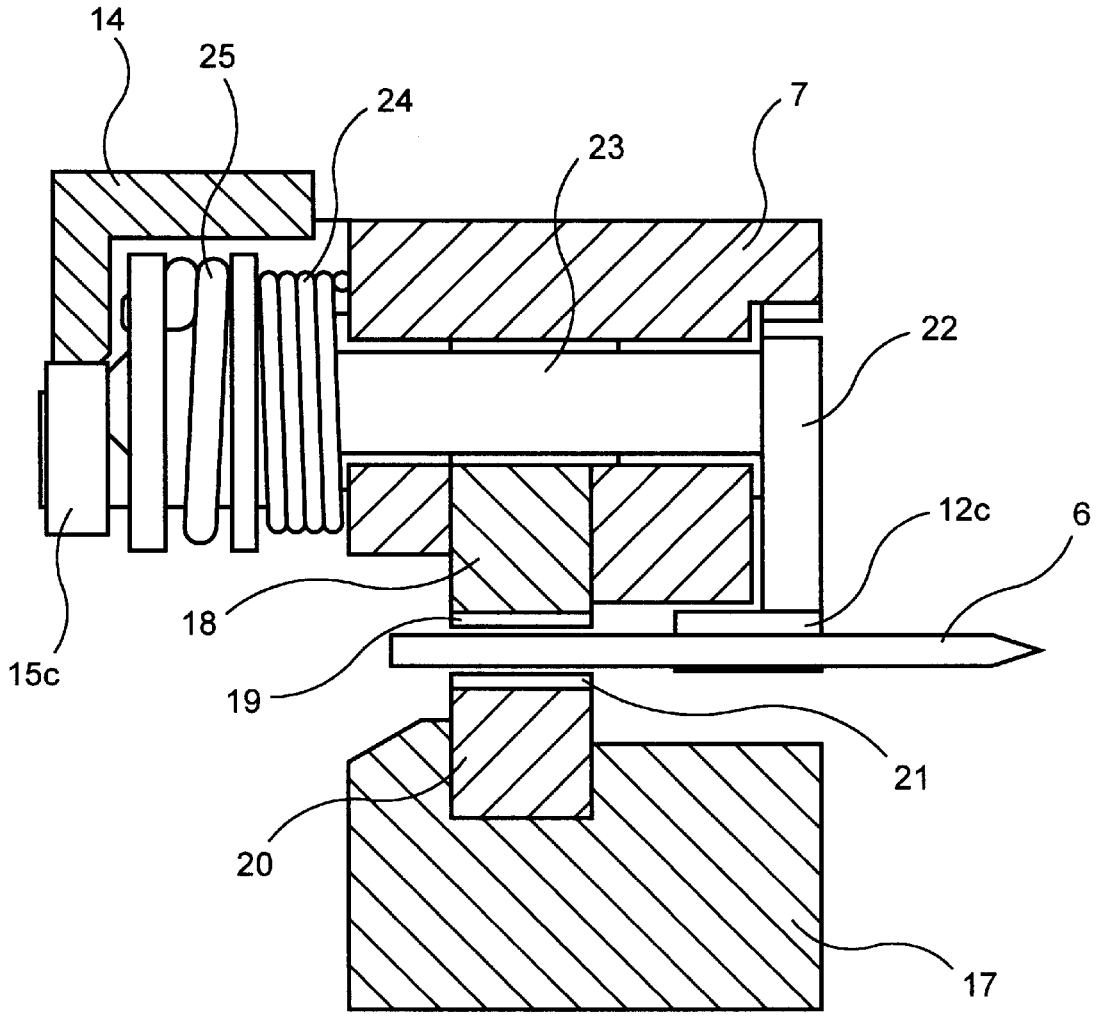
FIG. 3 is a sectional view along the line A—A in FIG. 2*b*.

Now, FIG. 3 illustrates a preferred embodiment of the movement mechanism of the movable holding jaw 12*a*, 12*b* and 12*c* shown in FIGS. 2*a* through 2*c*. A piece of wire 6 is shown which has been introduced between the tool ring 7 according to the present invention, and a second, opposed tool ring 17. In the tool ring 7, a holding tray 18 is arranged which is provided with a groove 19, and in a similar manner a corresponding holding tray 20 with a groove 21 is arranged in the opposed tool ring 17, and the two holding trays 18 and 20 are, during rotation of the tool rings 7, 17, squeezed together with great force around the piece of wire 6, this causing the latter to be secured relative to the tool rings 7, 17. However, the holding trays are unsuitable for quickly seizing and securing a piece of wire 6, and therefore the use of such tool rings presupposes a further engagement device for seizing and positioning the piece of wire relative to the grooves 19, 21 on the holding trays 18, 20. The engagement device shown in FIG. 3 corresponds to the one shown in FIGS. 2*a* through 2C and, and as mentioned in connection with said figures, it features a fixed holding jaw (not shown in FIG. 3) and a movable holding jaw 12*c* arranged on a lever 22 that extends radially outwards from a first extremity of a shaft 23 which is mounted pivotally in the tool ring 7.

At the other extremity of the shaft 23, a cam follower is arranged that comprises a cam roller 15*c* extending on a cam device 14 arranged along the internal periphery of the tool ring 7. Between the cam follower 23 and the tool ring 7, a torsion spring 24 is arranged which is biased so as to constantly aim at keeping the cam follower in abutment on the cam device, and pulling the holding jaw 12*c* away from its opposed, fixed holding jaw 11*c*. Moreover, the cam follower with the cam roller 15*c* is arranged to be rotatable on the shaft 23; and between the cam follower and the shaft, a torsion spring is arranged, said torsion spring being biased in such a manner that it seeks to bias the holding jaw 12 towards its oppose holding jaw 11*c*.

Thus, a movement mechanism is provided which serves to provide, throughout the major part of its movement range, a rigid transmission of force between the cam follower and the holding jaw; and wherein the torsion spring 24 works alone. However, an impact spring 25 is arranged having a spring constant that substantially exceeds the spring constant of the torsion spring 24; and wherein it is the sole purpose of the impact spring 25 to ensure that the abutment pressure between the holding jaws 11*c* and 12*c* and the piece of wire 6 is limited, since the cam follower is able to rotate relative to the shaft 23 against the spring force of the impact spring.

Now FIGS. 4*a* through 4*c* illustrate an alternative embodiment of the present invention wherein FIG. 4*a* is a front view sketch that illustrates a section of a first alternative embodiment of a tool ring according to the invention seen radially from the outside of the tool ring; and FIG. 4*b* is a sketch that illustrates a front view of the embodiment of a tool ring according to the invention shown in FIG. 4*a*, but wherein the ring has been straightened for space reasons; and FIG. 4*c* is a sketch illustrating the embodiment of a tool ring shown in FIGS. 4*a* and 4*b*, seen from the centre of the tool ring and radially outwards to the side.

Thus, FIG. 4*a* illustrates a tool ring 7 with an alternative configuration of the movement mechanism for the holding jaws: The tool ring is arranged to rotate in the direction indicated by the arrow B, and it will appear that this configuration is so arranged that each of the holding jaws of an engagement device is arranged to be movable relative to the tool ring 7. The holding jaw 26 is displaceably arranged in a parallel guide, and the holding jaw 27 is pivotally arranged in a bearing in the tool ring 7. In accordance with the principle behind of the invention, the two holding jaws 26 and 27 can be moved partially axially relative to the axis of rotation of the tool ring, and the movement pattern of the holding jaws 26 and 27 is illustrated by five different positions by means of a toothed wheel 28 arranged in the tool ring 7 and co-operating with a toothed bar arranged on the holding jaw 26, and an annular toothing on the holding jaw 27, whereby both holding jaws 26 and 27 can be moved by means of one and the same toothed wheel.

As will appear from FIG. 4*a*, the holding jaw 27 thus moves down below the surface 13 on the tool ring 7 in those positions where the piece of wire 6 is introduced to the tool ring 7, as will appear from FIG. 4*b*. Thereby the piece of wire 6 can, in accordance with the effect of the present invention, be introduced over a relatively protracted period of time without coming into contact with the holding jaw 27.

As will appear from FIG. 4*c*, the toothed wheel 28 is activated as a consequence of a cam follower and a cam device being provided on the internal periphery of the tool ring 7 which, in principle, corresponds to the device shown in FIGS. 2*b* and 2*c*.

Figure 5C:
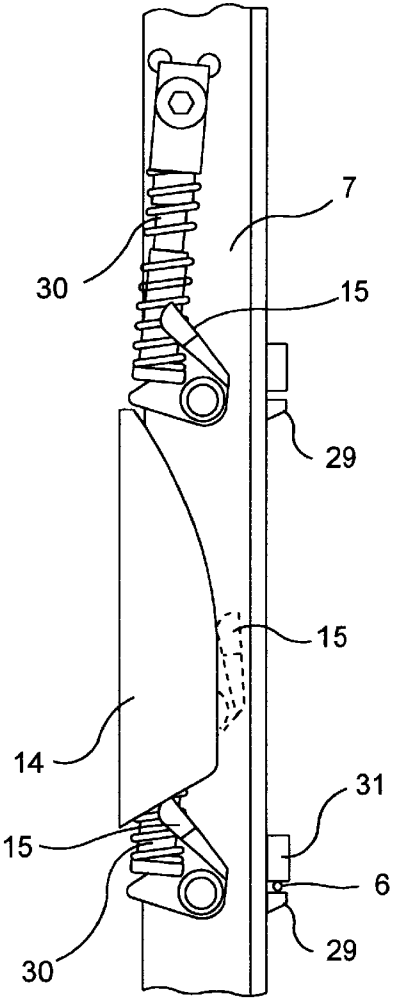
FIG. 5*c* is a sketch showing the embodiment of a tool ring in FIG. 5*a* and 5*b*, seen from the centre of the tool ring and radially outwards to the side.
Figure 5B:
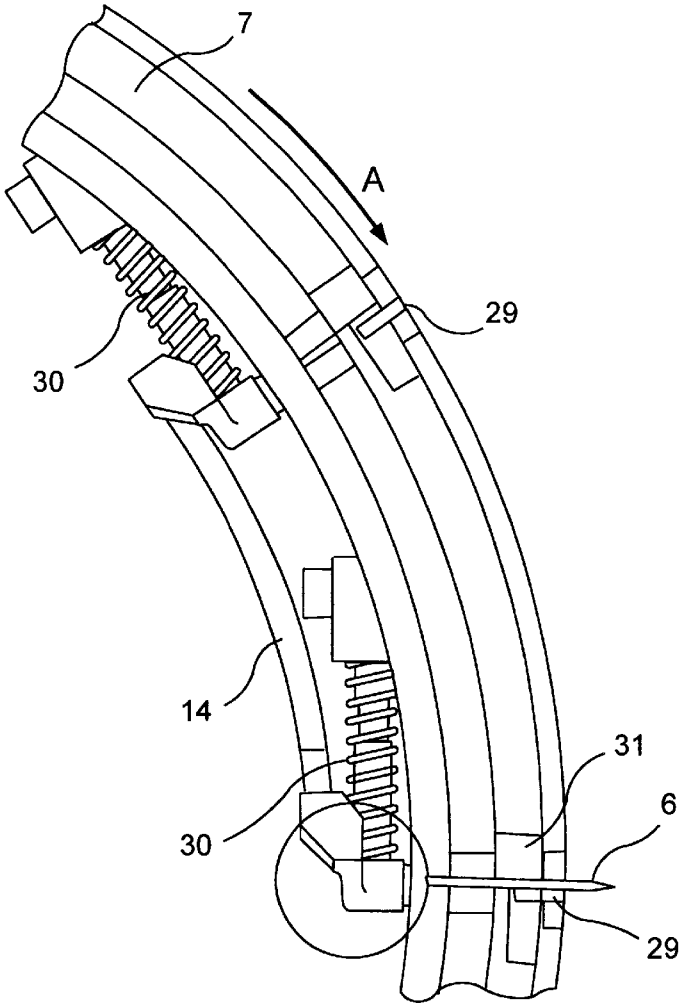
FIG. 5*b* is a sketch illustrating a front view of the embodiment of a tool ring according to FIG. 5*a*.
Figure 5A:
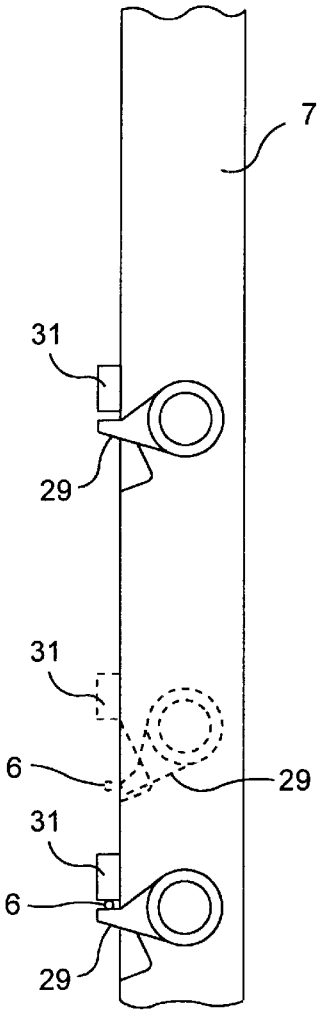
FIG. 5*a* is a sketch illustrating a sectional view of a second alternative embodiment of a tool ring according to the invention, seen radially from the outside of the tool ring.

On FIGS. 5*a* through 5*c* is further illustrated a second alternative embodiment of the present invention, comprising a tool ring 7 having a further alternative construction of the movement mechanism for the movable jaw 29. As can be seen from the figures the movement mechanism comprises a cam 14, a number of jaws 29 being pivotally arranged on an axle and wherein each axle has a cam follower 15 to engage the cam 14, so as to bring the movable and the opposed stationary jaw 31 into a closed and open position respectively.

A compression spring 30 is mounted such as to engage the cam follower 15 such as to urge the movable jaw into its closed position in which it presses against the stationary opposed jaw 31.

In this way the compression spring provides the holding force for holding the elongate bodies between the jaws 29, 31, and thereby no specific adjustments are necessary for shifting between producing e.g. nails from wires having different diameters.

Figure 6B:
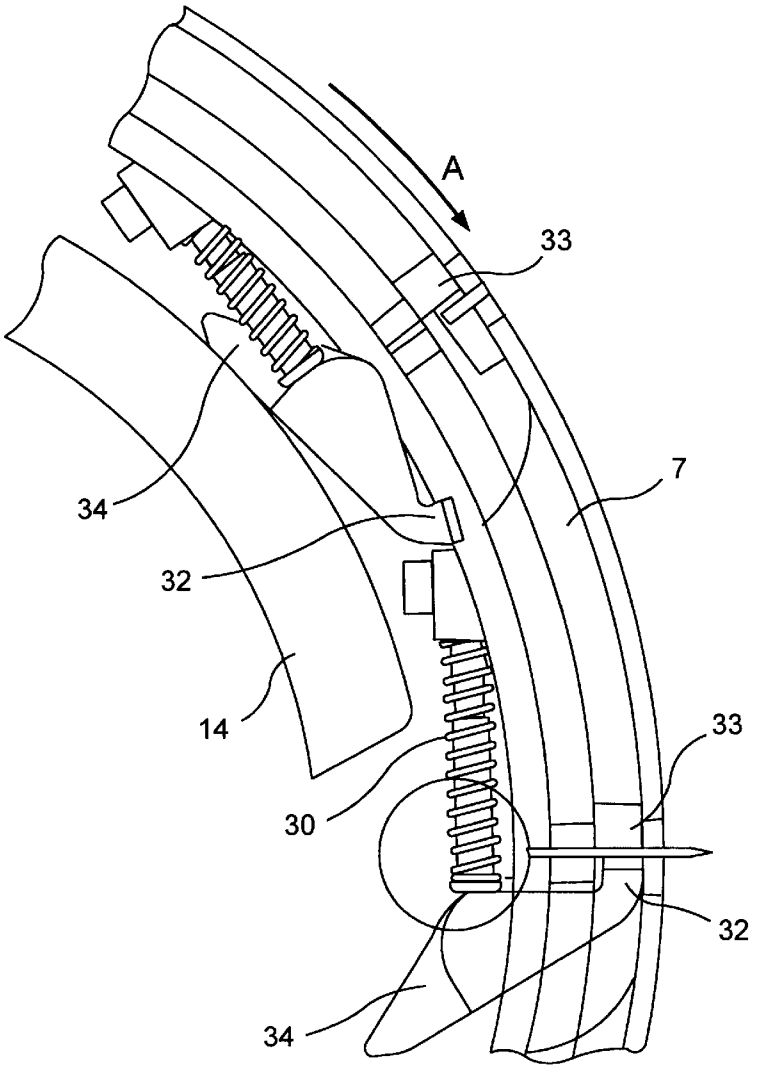
FIG. 6*b* is a sketch illustrating a front view of the embodiment of a tool ring according to FIG. 6*a*.
Figure 6A:
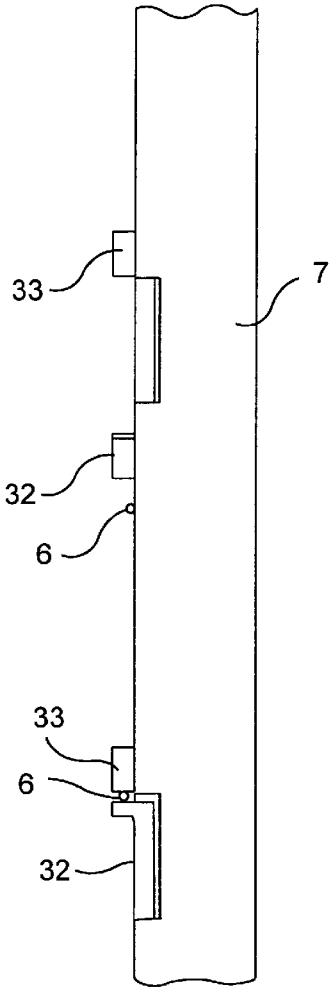
FIG. 6*a* is a sketch illustrating a sectional view of a third alternative embodiment of a tool ring according to the invention, seen radially from the outside of the tool ring.

FIGS. 6*a* and 6*b* show a third alternative embodiment of the invention, in which the movable jaw is not moved axially beneath the surface of the tool ring 7, but as an alternative solution is rotated about an axle being substantially parallel to the axis of rotation of the tool ring.

Figure 7:
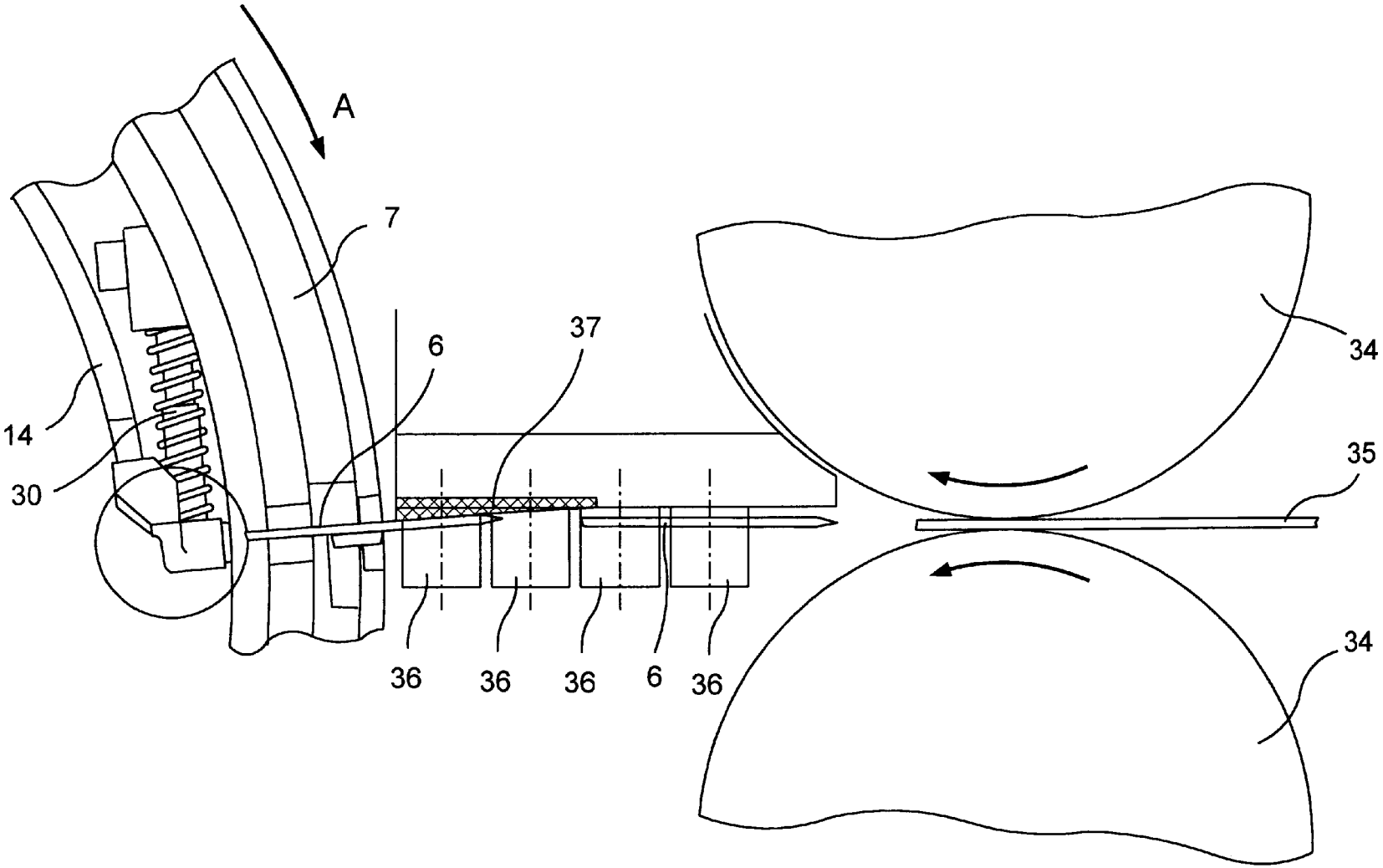
FIG. 7 is a sketch showing the means for introducing the elongate bodies to the tool ring.

On FIG. 7 is disclosed a preferred embodiment of the invention in which the elongate bodies are introduced into a tool ring 7, and wherein the means for introducing the elongate body comprises a rotating cutter having two rotating cutting cylinders 34 for cutting the elongate bodies 6 from a wire 35. From the cutting cylinders 34, the elongate bodies are forwarded in between a number of rotating roller pairs 36, and the rotating roller pairs are rotating in a direction so as to accelerate the elongate bodies 6 in order to forward the elongate bodies 6 into the tool ring 7. As can be seen from the figure the rotating roller pairs are only engaging the elongate bodies at one single point when the elongate bodies are relatively short. This gives rise to the problem that the elongate bodies may not be correctly inserted in to the tool ring, and thereby the risk of severe damages to the nail machine.

In the embodiment disclosed in FIG. 7, this is avoided by the use of a guiding surface 37 for the elongate bodies, the guiding surface having an angle with respect to the axis of rotation of the rotating roller pairs 35 being different from 90°, so that the rotating roller pairs cause the elongate bodies to press and slide against the guiding surface, and thereby the elongate bodies are stabilized.

Obviously, the present invention can be exercised in other manners than those shown as preferred embodiments in the drawings and explained above. Thus, the invention is also useful in connection with nail machines equipped with other types of wire cutters, etc. As regards the holding jaws, they may also have a configuration which is different from the ones shown herein, but such that their movement pattern includes at least an axial or radial movement constituent.

What is claimed is:

1. Apparatus for securing elongate bodies in a machine for the manufacture of heads on said elongate bodies, said apparatus comprising a tool ring having an axis of rotation, an outer circumference, and a surface that extend substantially perpendicular to said axis of rotation; said tool ring comprising a number of engagement devices to receive and releasably secure said elongate bodies to advance said elongate bodies to a station at which said heads are formed thereon, said engagement devices being equally spaced at the circumference of the tool ring, said engagement devices each comprising two holding jaws, each having holding faces, at least one of the two holding jaws being movable by a movement mechanism so that the movable holding jaw can be displaced towards and away from the opposed holding jaw in respective closed and open positions, said movement mechanism displacing the movable holding jaw to said open position completely away from an area in front of the holding face of the opposed jaw in its closed position, each of said engagement devices further comprising a pair of opposed holding trays disposed in spaced relation relative to a respective pair of holding jaws, for squeezing one said elongate body therebetween with said elongate body engaged by said jaws in the closed position thereof.

2. Apparatus according to claim 1, further comprising a second tool ring, one of said opposed holding trays being secured to the first said tool ring, the other of said opposed trays being supported by the second tool ring.

3. Apparatus according to claim 2, wherein said opposed holding trays are axially spaced from said pair of holding jaws and are provided with grooves facing one another for engaging said elongate bodies.

4. Apparatus according to claim 2, wherein said first and second tool rings are concentric and rotatable about a common axis.

5. Apparatus according to claim 2, wherein said opposed holding trays act to squeeze one said elongate body therebetween to secure said elongate body whereas said holding jaws act to quickly engage said elongate body to seize and position said elongate body for squeezing by said holding trays.

6. Apparatus according to claim 1, wherein the opposed holding jaw is immovably secured on the tool ring, said tool ring being rotatable in a direction to position the movable holding jaw of each engagement device opposite the immovably secured opposed holding jaw.

7. Apparatus according to claim 6, wherein the engagement device is configured for receiving and securing the elongate bodies such that the elongate bodies extend opposite that surface of the tool ring which is located substantially perpendicular to the axis of rotation and substantially radially inwards towards the axis of rotation of the tool ring; and wherein the movement mechanism is arranged to displace the movable holding jaw in a direction which is axial relative to the axis of rotation of the tool ring.

8. Apparatus according to claim 6, wherein the movable jaw is displaced in a direction which is radial with respect to the axis of rotation of the tool ring.

9. Apparatus according to claim 5, wherein each of the movement mechanisms in the tool ring comprises a shaft which is rotatably arranged in the tool ring; and the movable holding jaw is arranged on a lever which is secured to said shaft of the movement mechanism and extends radially outwards therefrom; the rotatable shaft being further provided with a cam follower.

10. Apparatus according to claim 9, comprising a spring arranged between said shaft on the movement mechanism and the tool ring to provide a spring force to urge the movement mechanism to rotate and cause the movable holding jaw to move to its closed position.

11. Apparatus according to claim 2, wherein the rotatable shaft of the movement mechanism has an axis of rotation which extends substantially radially inwards towards the axis of rotation of the tool ring.

12. Apparatus according to claim 6, wherein the immovably secured holding jaw has a holding surface that faces in the direction of rotation of the tool ring; the movable holding jaw has a holding surface that, in the closed position of the movable jaw, faces substantially towards the immovably secured holding surface.

13. Apparatus according to claim 1, comprising a drive device for pulling a metal wire from a storage; a device for stretching and straightening the wire, a cutter for cutting elongate bodies having a desired length off said wire; means for introducing the elongate bodies to the tool ring; a roller for rolling heads onto the elongate bodies; and means for removing and collecting the elongate bodies provided with heads and for conveying the elongate bodies away from said roller.

14. Apparatus according to claim 13, wherein the means for introducing the elongate bodies to the tool ring comprises a guiding surface and a number of rotating roller pairs having an axis of rotation differing from 90°, so as to simultaneously move the elongate bodies along and against the guiding surface.

* * * * *